US006039482A

United States Patent [19]

Smal

[11] Patent Number: 6,039,482

[45] Date of Patent: Mar. 21, 2000

[54] HOT WAX HAIR REMOVER APPARATUS

[75] Inventor: Henri Smal, Blegny, Belgium

[73] Assignee: Conair Corporation, Stamford, Conn.

[21] Appl. No.: 09/233,016

[22] Filed: Jan. 19, 1999

[51] Int. Cl.[7] ..... A46B 11/08

[52] U.S. Cl. ..... 401/1; 401/131

[58] Field of Search ..... 401/1, 2, 131, 401/208, 3, 138, 209, 218, 262; 248/685, 688; 219/552, 553

[56] References Cited

U.S. PATENT DOCUMENTS

| | | | |
|---|---|---|---|
| 4,113,212 | 9/1978 | Coriden | 248/13 |
| 4,465,073 | 8/1984 | Schwob | 128/355 |
| 4,770,385 | 9/1988 | Bahm . | |
| 4,773,784 | 9/1988 | Mann | 401/1 |
| 4,940,204 | 7/1990 | Nelson et al. | 248/688 |
| 4,958,951 | 9/1990 | Mann | 401/1 |
| 5,253,440 | 10/1993 | Chang . | |
| 5,803,636 | 9/1998 | Legrain et al. | 401/1 |

FOREIGN PATENT DOCUMENTS

| | | |
|---|---|---|
| 0 783 849 A1 | 12/1996 | European Pat. Off. . |
| 2 653 978 | 11/1989 | France . |

*Primary Examiner*—Henry J. Recla
*Assistant Examiner*—Huyen Le
*Attorney, Agent, or Firm*—Ohlandt, Greeley, Ruggiero & Perle

[57] ABSTRACT

A hot wax hair remover apparatus comprising a heating sleeve (1) for depilatory wax equipped with a wax applicator (6) wherein the heating sleeve (1) is provided with a retractable foot (5) equipped with a spring (7) holding the foot (5) in the deployed position and with means (7, 9) for locking the toot (5) in a retracted position, against the force of the spring (7), controlled by a catch (11) arranged at the base of the sleeve (1) which releases the locking means (7, 9) when the sleeve (1) is put down on a support surface.

4 Claims, 4 Drawing Sheets

HOT WAX HAIR REMOVER APPARATUS

OBJECT OF THE INVENTION

The present invention relates to a hot wax hair remover apparatus comprising an electric heating sleeve for heating depilatory wax and for keeping it in the liquid state, which is equipped with a wax applicator.

The heating sleeve includes a receptacle into which a mass (generally a stick) of depilatory wax is inserted, in the solid state, and which is equipped with electric heating means for liquefying said wax.

The most common form of wax applicator consists of a roller which picks up the wax in the liquid state and applies it to the skin by rolling.

BACKGROUND OF THE INVENTION

Hot wax hair remover devices of the kind are described in U.S. Pat. Nos. 4,733,784 and 4,956,951.

The difficulty, and the problem at the basis of the invention, arises from the need to avoid placing the sleeve down flat, which would cause the wax to flow out.

Naturally, it is possible to envisage to use a stand as it is shown in the above mentioned U.S. patents into which the sleeve is slipped and which keeps it upright.

However, when the sleeve is used, for example, in a bathroom, the stand is not always in the place where one wishes to put down the sleeve. Moreover, when travelling, for example, this stand is too cumbersome.

The invention thus aims to facilitate use of the sleeve.

SUMMARY OF THE INVENTION

The hot wax hair remover apparatus of the invention comprises essentially a heating sleeve and a wax applicator wherein the heating sleeve is provided with a retractable foot equipped with a spring holding the foot in the deployed position and with a means for locking the foot in the retracted position, against the force of the spring, controlled by a catch arranged at the base of the sleeve which releases the locking means when the sleeve is put down on a support surface, such as a table.

Further details and characteristics of the invention will become apparent to those skilled in the art on reading the description of a preferred embodiment of the invention, with reference to the appended figures.

DESCRIPTION OF A PREFERRED EMBODIMENT OF THE INVENTION

Figure 1:
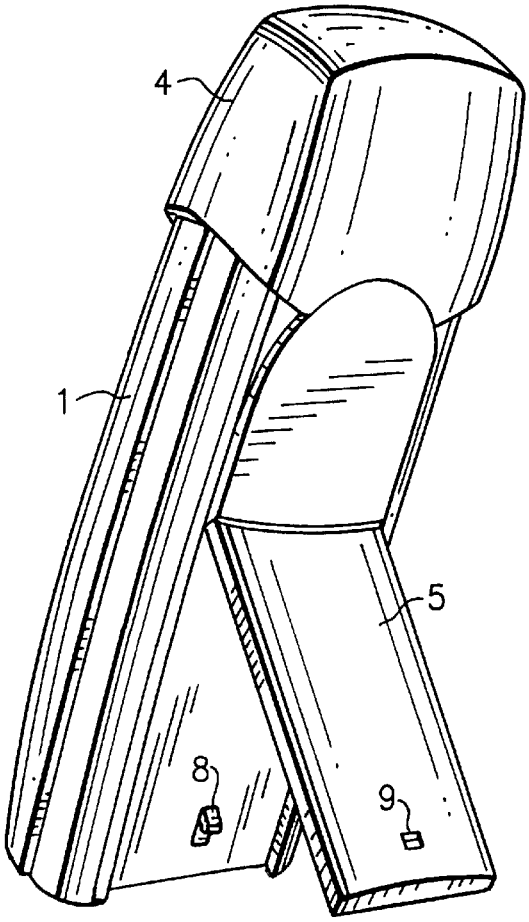
FIG. 1 shows a perspective view of the rear of the apparatus according to the invention provided with a cap.

The sleeve, which bears the reference numeral 1 includes a receptacle 2 electrically heatable by means of resistors 3. A cap 4 covers the sleeve 1 when it is not in use.

Figure 2:
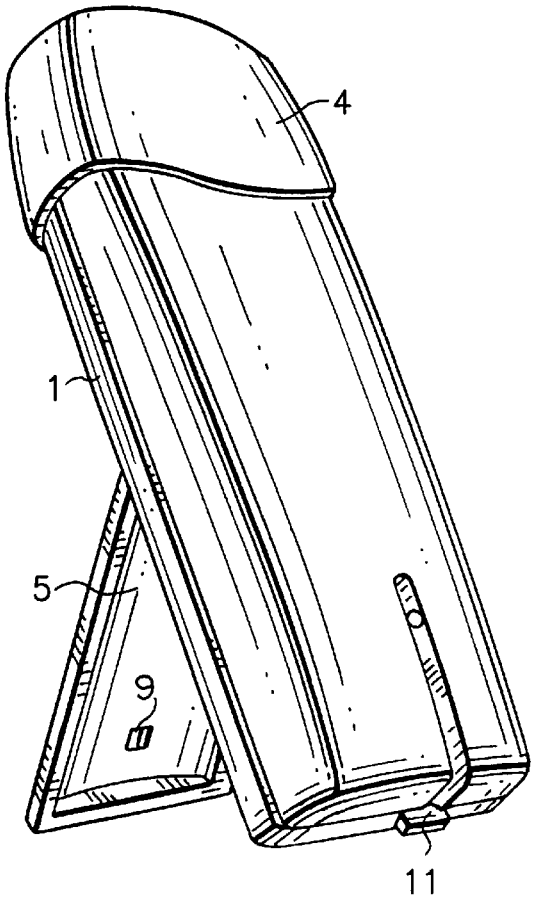
FIG. 2 shows a corresponding perspective view of the front of the apparatus of FIG. 1.
Figure 3:
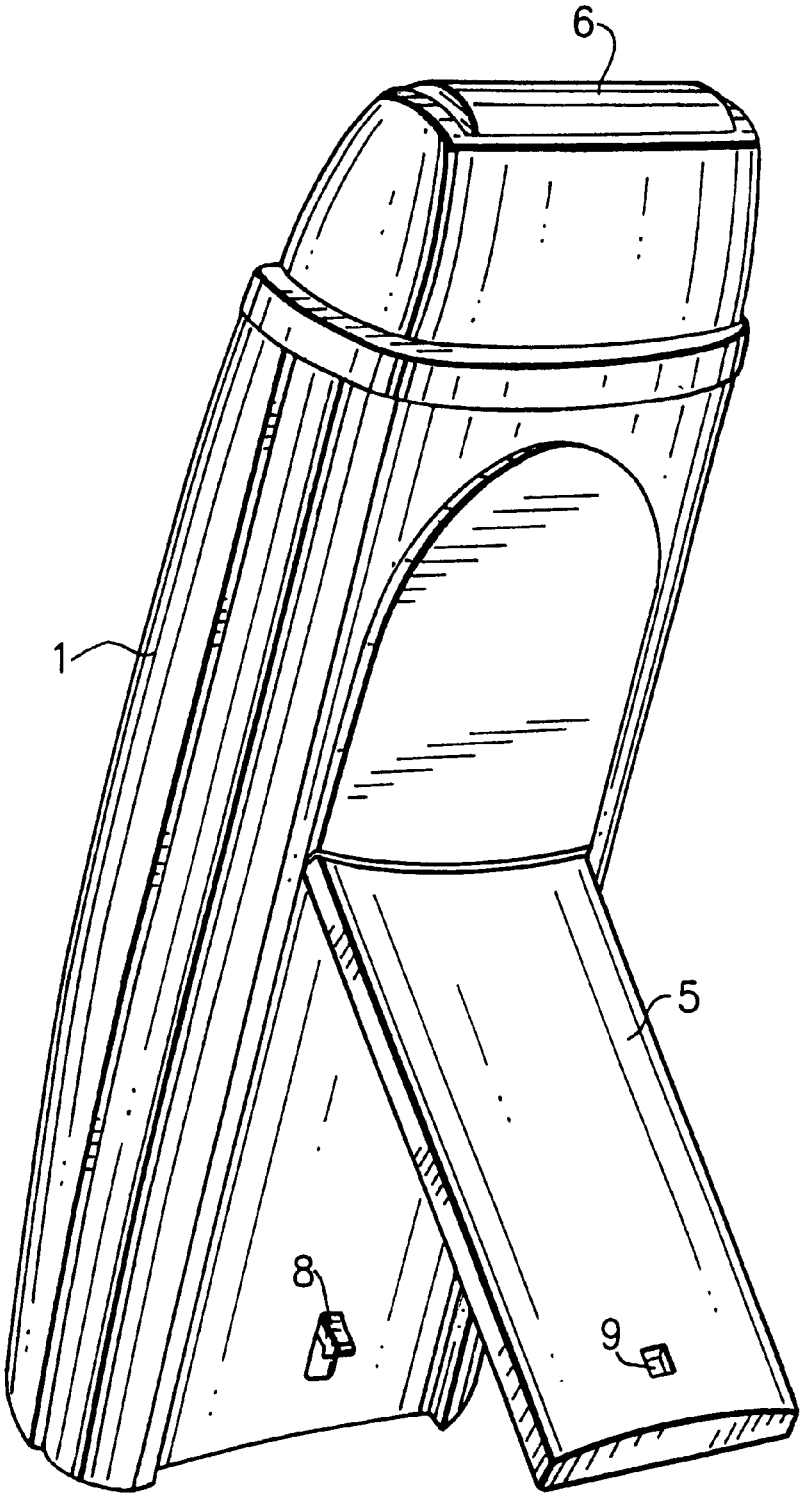
FIG. 3 is a view similar to Figure where the cap has been removed and showing the roller acting as the wax applicator.
Figure 4:
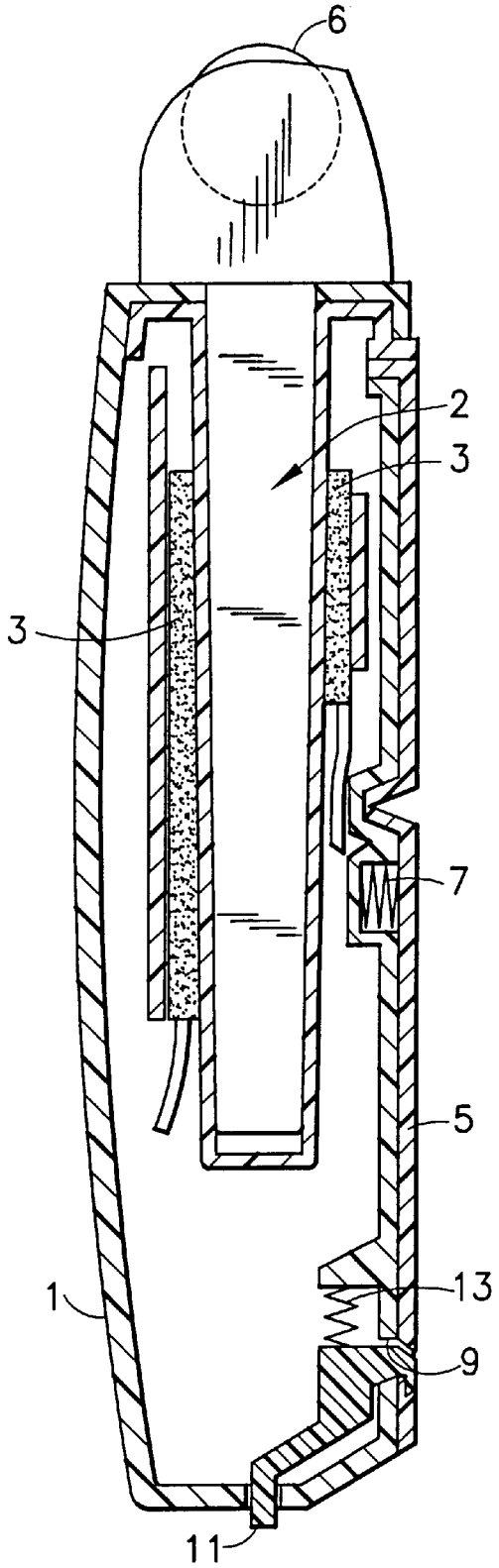
FIG. 4 is a section view of the apparatus shown in FIG. 3 in a retracted position.
Figure 5:
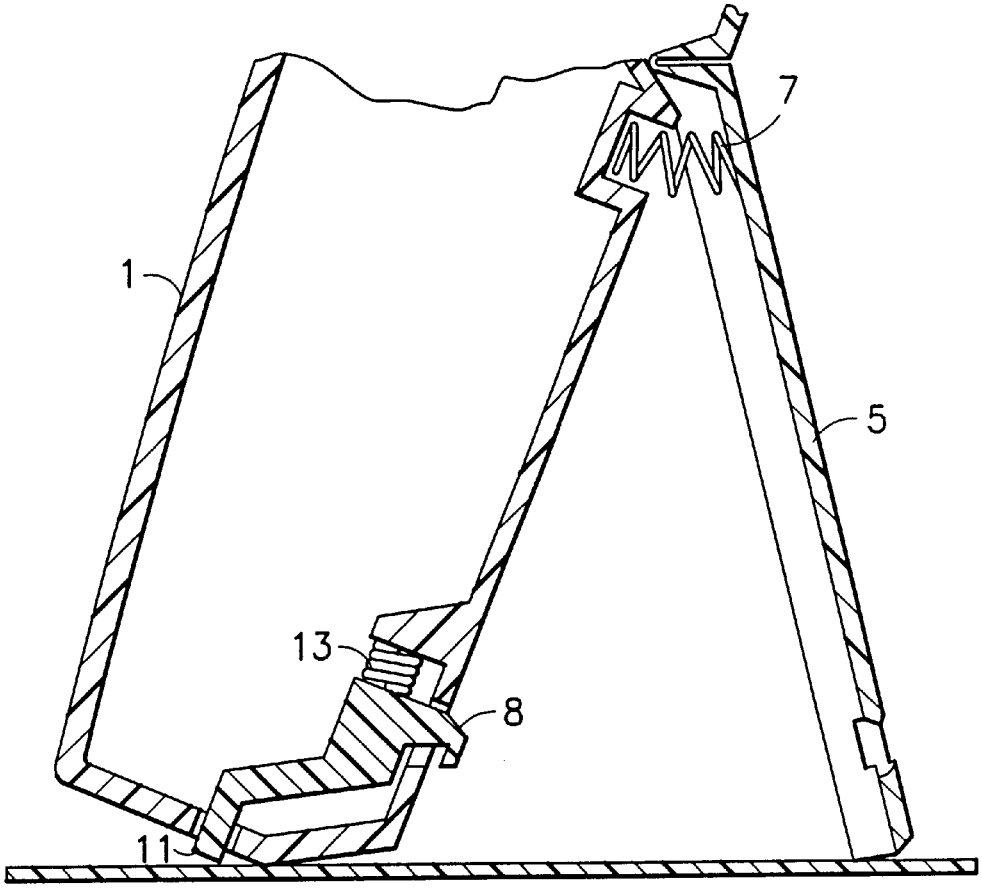
FIG. 5 is a detail section view of the apparatus in a deployed position.

A foot 5 articulated on a hinge is arranged on the rear face of the sleeve 1. When opened out, as shown in FIGS. 1–3, this foot makes it possible to keep the sleeve 1 upright when it is placed on a table, for example.

Means for applying the wax comprising a roller 6 are provided on the top of the sleeve 1.

A spring 7 keeps the foot 5 in the deployed position.

The foot 5, however, may be retracted by being folded down against the force of the spring 7 by means of pressure applied to the rear face of the sleeve and it is then maintained on the rear face of the sleeve by a fastening lug a which engages into a recess 9 in the foot 5 by snap-fitting in its retracted position.

The sleeve 1 includes a catch 11, which can be seen at the base of the sleeve, which, by being pushed into the body of the sleeve when the sleeve is put down vertically on a support surface (a table, for example), pushes the lug 8 against the action of a spring 13 out of its snap-fit position into the recess 9, thereby giving rise to the deployment of the foot 5.

By holding the sleeve 1 in the palm of one's hand, it is thus possible easily to fold the foot 5 down with one's fingers while, by putting the sleeve down vertically on a hard surface, it is possible, by means of the catch 11, to deploy it.

Preferably, a space is managed between the receptable 2 with the resistors 3 on the one hand and the sleeve 1 on the other hand, wherein an insulation avoiding overheating of the sleeve proper which could cause burns in use may be provided.

An mentioned above, the wax which is introduced into the receptable 2 is preferably in a stick form but chips of wax could as well as poured into said receptacle.

I claim:

1. A hot wax hair remover apparatus comprising a heating sleeve for depilatory wax, equipped with a wax applicator wherein the said heating sleeve is provided with a retractable foot equipped with a spring holding the foot in a deployed position and with means for locking the said foot in the retracted position, against the force of the said spring, controlled by a catch arranged at the base of the said sleeve which releases the said locking means when the said sleeve is put down on a support surface.

2. An apparatus according to claim 1, wherein the said foot can be retracted by being folded down, against the force of the said spring, to maintain the said foot on one face of the sleeve.

3. An apparatus according to claim 1, wherein the said locking means consists of a fastening lug which engages into a recess in the said foot by snap-fitting in order to maintain the said foot on one face of the said sleeve.

4. An apparatus according to claim 1 wherein the said catch, by being pushed into the body of the said sleeve when it is put down vertically on a support surface, pushes the said lug out of its snap-fit position into the said recess, thereby giving rise to the deployment of the said foot.

* * * * *

UNITED STATES PATENT AND TRADEMARK OFFICE

CERTIFICATE OF CORRECTION

PATENT NO. : 6,039,482
DATED : March 21, 2000
INVENTOR(S) : Henri Smal

It is certified that error appears in the above-identified patent and that said Letters Patent is hereby corrected as shown below:

ABSTRACT,
Line 5, please correct "with means (7, 9)" to read -- with means (8, 9) --.
Line 6, please correct "toot" to read -- foot --.
Lines 8 and 9, please correct "means (7, 9)" to read -- means (8, 9) --.

Column 2,
Line 16, please correct "fastening lug a" to read -- fastening lug 8 --.
Line 34, please correct "An mentioned" to read -- As mentioned --.

Column 2, claim 4,
Line 55, please correct "according to claim 1" to read -- according to claim 3 --.

Signed and Sealed this

Nineteenth Day of February, 2002

*Attest:*

*Attesting Officer*

JAMES E. ROGAN
*Director of the United States Patent and Trademark Office*